US005694991A

United States Patent [19]

Harris et al.

[11] Patent Number: 5,694,991

[45] Date of Patent: Dec. 9, 1997

[54] VALVE ASSEMBLAGE AND METHOD OF USE

[75] Inventors: Clark E. Harris, Fairport; David Lynn Patton, Webster; Bradley Stephen Bush, Hilton, all of N.Y.

[73] Assignee: Eastman Kodak Company, Rochester, N.Y.

[21] Appl. No.: 557,884

[22] Filed: Nov. 14, 1995

Related U.S. Application Data

[63] Continuation-in-part of Ser. No. 380,878, Jan. 30, 1995, abandoned, which is a continuation-in-part of Ser. No. 220,984, Mar. 31, 1994, abandoned.

[51] Int. Cl.[6] ..... B65B 1/04

[52] U.S. Cl. ..... 141/346; 141/349; 141/351; 137/614.03

[58] Field of Search ..... 141/346–355, 141/357, 356, 359, 18; 137/641.03, 614.04; 222/501, 518, 325

[56] References Cited

U.S. PATENT DOCUMENTS

| | | | |
|---|---|---|---|
| Re. 32,354 | 2/1987 | Savage | 222/81 |
| 497,896 | 5/1893 | Ruppel . | |
| 2,401,674 | 6/1946 | Vizay | 284/18 |
| 2,661,135 | 12/1953 | Fraser | 226/125 |
| 3,291,152 | 12/1966 | Comer | 137/614 |
| 3,513,887 | 5/1970 | Limandri | 141/207 |
| 3,858,229 | 12/1974 | Stievenart et al. | 354/331 |
| 3,940,018 | 2/1976 | Schoole | 222/1 |
| 3,977,569 | 8/1976 | Scholle | 222/105 |
| 4,002,267 | 1/1977 | Aelterman et al. | 222/1 |
| 4,014,461 | 3/1977 | Harvill | 222/94 |
| 4,150,673 | 4/1979 | Watt | 128/272 |
| 4,197,942 | 4/1980 | Gacki et al. | 206/219 |
| 4,216,885 | 8/1980 | Sedam | 222/481 |
| 4,275,823 | 6/1981 | Credle, Jr. | 222/94 |
| 4,368,010 | 1/1983 | Kohlbauer et al. | 417/271 |
| 4,375,864 | 3/1983 | Savage | 222/81 |
| 4,380,310 | 4/1983 | Schneiter et al. | 222/501 |
| 4,445,539 | 5/1984 | Credle | 137/614.03 |
| 4,564,132 | 1/1986 | Lloyd-Davies | 222/522 |
| 4,576,313 | 3/1986 | Smith et al. | 222/81 |
| 4,709,835 | 12/1987 | Kruger et al. | 222/87 |
| 4,804,117 | 2/1989 | Rudick | 222/214 |
| 4,874,023 | 10/1989 | Ulm | 141/346 |
| 4,907,019 | 3/1990 | Stephens | 346/140 R |
| 4,949,745 | 8/1990 | McKeon | 137/614.03 |

(List continued on next page.)

FOREIGN PATENT DOCUMENTS

| | | | |
|---|---|---|---|
| 229612 | 10/1963 | Austria . | |
| 276994 | 3/1988 | European Pat. Off. | B65D 77/06 |
| 270302 | 8/1988 | European Pat. Off. | B67D 1/08 |
| 500371 A2 | 2/1992 | European Pat. Off. | G03D 3/06 |
| 1066118 | 5/1952 | France | 5/3 |
| 5002240 | 1/1993 | Japan | G03C 5/00 |
| 1223781 | 3/1971 | United Kingdom . | |
| 9323328 | 11/1993 | WIPO | B67D 5/02 |

OTHER PUBLICATIONS

*Research Disclosure*, Oct. 1973; "Dispensing Apparatus for Chemicals", Disclosure No. 11440, 2 pages.

*Primary Examiner*—Henry J. Recla
*Assistant Examiner*—Steven O. Douglas
*Attorney, Agent, or Firm*—Charles E. Snee, III

[57] ABSTRACT

A valve assemblage (10, 50) for controlling the flow between fast and second containerized systems ($C_1$, $C_2$) having first and second openings (A,B), respectively. The assemblage comprises a first valve assembly (12, 52) positioned at the first opening of the fast containerized system and a second valve assembly (14, 54) positioned at the second opening of the second containerized system. A piston (20, 84) in the first valve assembly, when in a first position opens an entrance port (18, 100) for receiving fluid from or passing fluid into the first containerized system; and correspondingly, a retractable sleeve (36, 136) in the second valve assembly (14, 54) opens an entrance port (30, 122) in a proboscis member (26, 110) having a channel (28, 118) and outlet (32, 142, 144) for passing fluid to or receiving fluid from the second containerized system.

16 Claims, 11 Drawing Sheets

U.S. PATENT DOCUMENTS

| | | | |
|---|---|---|---|
| 4,958,666 | 9/1990 | Kocourek et al. | 141/114 |
| 4,976,381 | 12/1990 | Scholle et al. | 222/484 |
| 4,991,635 | 2/1991 | Ulm | 141/346 |
| 5,031,676 | 7/1991 | Ulm | 141/346 |
| 5,058,780 | 10/1991 | Plester et al. | 222/321 |
| 5,070,351 | 12/1991 | Vanover et al. | 354/299 |
| 5,072,756 | 12/1991 | Carr | 137/614.04 |
| 5,095,962 | 3/1992 | Lloyd-Davies et al. | 141/346 |
| 5,100,030 | 3/1992 | Roggenburg, Jr. et al. | 222/181 |
| 5,118,015 | 6/1992 | Scholle et al. | 222/484 |
| 5,135,137 | 8/1992 | Rudick | 222/1 |
| 5,255,713 | 10/1993 | Scholle et al. | 137/614.04 |
| 5,293,913 | 3/1994 | Preszler | 141/367 |
| 5,295,518 | 3/1994 | Baker et al. | 141/18 |
| 5,353,085 | 10/1994 | Kurematsu et al. | 354/324 |
| 5,392,939 | 2/1995 | Hidding et al. | 215/265 |

96
98
120
100
66
132
134
62
80
78
136
124
82
128
88
86
84
52
126
100
132
130
54
132
122
118
110

94
92
84
86
88

SEE FIG. 8
56
C1
60
100
68
70
64
62
74
76
84
90
86
82
80
78
A
88
58
100
52
66

126
136
134
104
102
110
106
114
116
112
118
TO C2
54
138
B
140
108
142
144
50

VALVE ASSEMBLAGE AND METHOD OF USE

CROSS REFERENCE TO RELATED APPLICATIONS

This application is a continuation in part of Ser. No. 08/380,878 filed 30 Jan. 1995 by Clark E. Harris, David L. Patton and Bradley S. Bush now abandoned, which, is a continuation-in-part of Ser. No. 08/220,984 filed 31 Mar. 1994 by Clark E. Harris and David L. Patton and now abandoned.

FIELD OF THE INVENTION

The present invention relates to a valve assemblage and method of using the valve assemblage. More particularly, the invention concerns a valve assemblage and method for controlling the flow of a fluid between a container and a mating system which uses the fluid, such as a chemical replenishment container and a photoprocessing or photoprinting machine, substantially without exposing the user to such fluid.

BACKGROUND OF THE INVENTION

Flow control devices, such as valves, are widely used for regulating the flow of materials, primarily fluids, from one containerized system to another. A conventional way to supply a fluid material to a containerized system, such as photoprinting machine, involves dispensing the fluid material from a receptacle, for example a flexible container, into a fluid reservoir or distribution channel in the photoprocessing machine. In such applications, the fluids typically are liquid chemicals. The flexible containers or bottles currently used to replenish chemicals in these machines often require that the user first open the container and then pour the contents into the photoprinting machine. One problem that results during the transfer of the chemicals is leakage. Chemical leakage, of course, exposes the operator to potential harmful effects of the material. Waste of chemicals and associated cost are related problems of the present systems. These shortcomings necessitate a need to supply materials, such as photographic chemicals, to photoprocessing machines, and the like, in a containerized system and without leakage. Such systems would then present to the operator as a dripless or dry transfer system.

Consequently, a need has existed in the prior an to provide a dry system for transferring materials between containerized systems. Preferably, in such a system, a flow control or valving arrangement would communicate with both containerized systems (e.g., the flexible container for photographic chemicals and the photoprinting machine) and would be utilized such that when one containerized system is removed from the other, the valving arrangement would close and the user would not be exposed to leakage.

U.S. Pat. No. 4,958,666 discloses a storage canister for process fluids, which includes a receptacle having leakage proof pouches of elastic material each having an opening closed by a control valve. The normally closed controlled valve is activated by suction or by over-pressure from suction or pressure devices in the processing apparatus. European published application No. A-270 302 discloses a fluid coupling in which a collapsible liquid container includes a first coupling member having a hollow post with drainage openings normally closed by a spring-biased sleeve. A second coupling member includes a spring-biased valve member which is engaged by the post when the coupling is assembled, thereby opening the valve. A surrounding lip on the second coupling member engages and moves the sleeve to open the drainage openings.

SUMMARY OF THE INVENTION

An object of the invention is to provide a valve assemblage that eliminates leakage during fluid transfer between mating containerized systems.

Another object of the invention is to provide a valve assemblage for controlling the supply of a fluid to a first containerized system without the user's having to open a second containerized system prior to transferring the fluid into the fast containerized system.

Still another object of the present invention is to provide a valve assemblage for controlling the supply of a fluid from a fast to a second containerized system in which, during removal of the first containerized system from the second containerized system, no fluid is leaked.

Another object of the invention is to provide a valve assemblage that can open and close a flow path between mating containerized systems without leakage.

Yet another object of the invention is to provide a method for transferring fluids between mating containerized systems without leakage and waste of the transferred material.

Accordingly, for accomplishing these and other objects of the invention, there is provided a valve assemblage adjoining first and second containerized systems, the first and second containerized systems having first and second openings, respectively. A first valve assembly is positioned at the first opening. The first valve assembly comprises a body member, a fluid entrance port in the body member to receive fluid from the first containerized system, a piston slideable within the body member from a first position closing the entrance port, to a second position opening the closed entrance port, and a spring member normally biasing the piston to the first position. A second valve assembly is positioned at the second opening. The second valve assembly comprises a proboscis member having a channel with an inlet end to receive fluid from the fluid entrance port and an outlet end to deliver the received fluid to the second containerized system. The inlet end is positioned at a first end portion of the proboscis member. A blocking member is moveable relative to the proboscis member from a first position closing the inlet end to a second position opening the inlet end. A second spring member normally biases the blocking member to the position closing the inlet end.

When the first opening is urged toward the second opening, the first body member of the first valve assembly engages and moves the blocking member of the second valve assembly to open the inlet end of proboscis member. The proboscis member displaces the piston of the first valve assembly into the second position opening the entrance port. As a result, the opened entrance port is in fluid communication with the opened inlet end to form an open fluid flow channel between the first and second containerized systems. Flow of liquid may go in either direction, depending on which system is being filled and which is being drained.

Further, when the first opening is urged away from the second opening, the body member of the first valve assembly is withdrawn from the proboscis member of the second valve assembly. The blocking member then moves to close the inlet end of the proboscis member, and the proboscis member disengages from the piston to allow the piston to slide to the position closing the entrance port, thereby preventing the flow of fluid from or between the first and second containerized systems.

In the just-described embodiment of the invention, when the first opening is urged toward the second opening, the blocking member opens the inlet end before the piston is displaced sufficiently to position the entrance port in communication with the through channel; and when the first opening is urged away from the second opening, the piston closes the entrance port before the blocking member closes the through channel. As a result of this arrangement, leakage from the first system containing fluid to be dispensed is prevented when the first opening is urged toward or away from the second opening.

The blocking member may be a sleeve telescoped over the proboscis member. The first containerized system may include a spout having a bore to receive the body member. The body member may be provided with a trio of circumferential shoulders for sequentially engaging a groove within the bore, to permit partial engagement of the body member within the bore. To provide an improved seal between the body member and the bore, even in the event of mold parting line mismatch on the body member, one of the shoulders may be provided a narrow, radial seal flange to engage the bore. A resilient seal may be provided between the proboscis member and the blocking member.

The blocking member may be a sleeve member surrounding the inlet end of the proboscis member and movable from the position closing the inlet end to the position opening the inlet end. The seal on the proboscis member may comprise a base disk engaging the first end portion and a perforated cylindrical wall being extended between the proboscis member and the sleeve member. The engaging surfaces of the proboscis member and the piston may include means for preventing entrapment of fluid there between.

Accordingly, advantageous effects of the present invention are that it provides valve assemblages and a method for controlling the flow of fluids between mating containerized systems without leakage before, during or after engagement. The assemblages are inexpensive and easy to manufacture and simple to assemble and use.

BRIEF DESCRIPTION OF THE DRAWINGS

The foregoing as well as other objects, features and advantages of our invention will become more apparent from the appended Figures, wherein like reference numerals denote like elements, and wherein.

DETAILED DESCRIPTION OF THE INVENTION

Figure 1:
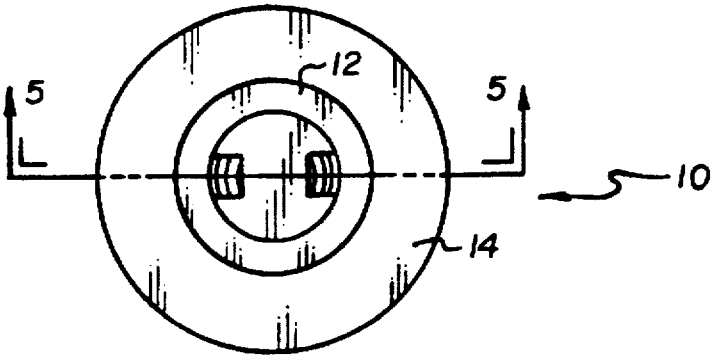
FIG. 1 is a top view of one embodiment of our valve assemblage when disengaged.
Figure 2:
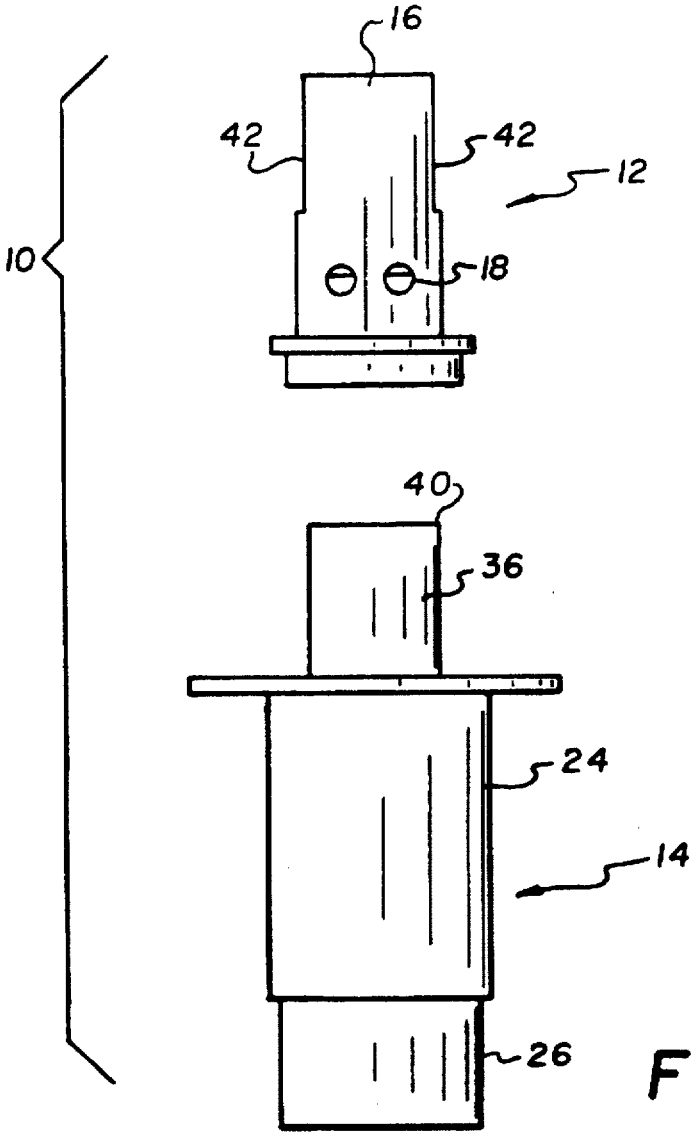
FIG. 2 is an elevation view of the valve assemblage of FIG. 1 when disengaged.
Figure 3:
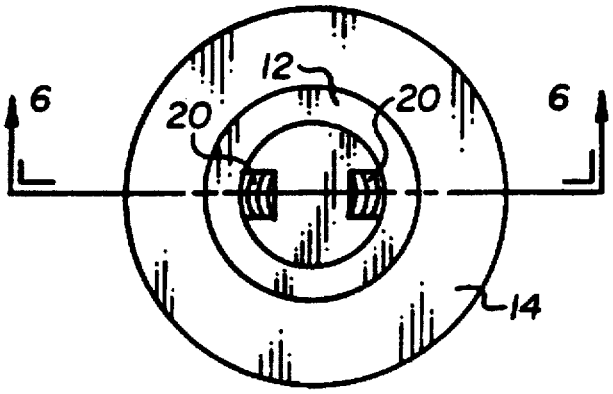
FIG. 3 is a top view of one embodiment of our valve assemblage when engaged.
Figure 4:
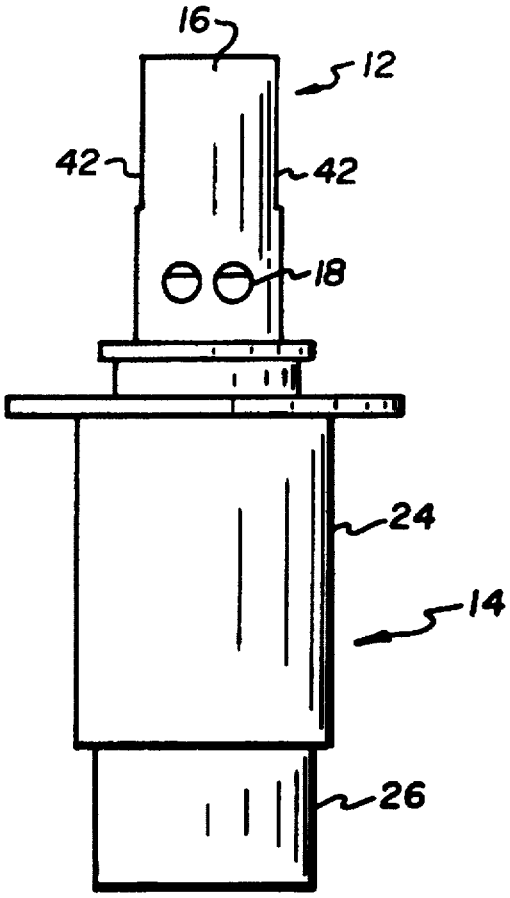
FIG. 4 is an elevation view of the valve assemblage of FIG. 3 when engaged.
Figure 5:
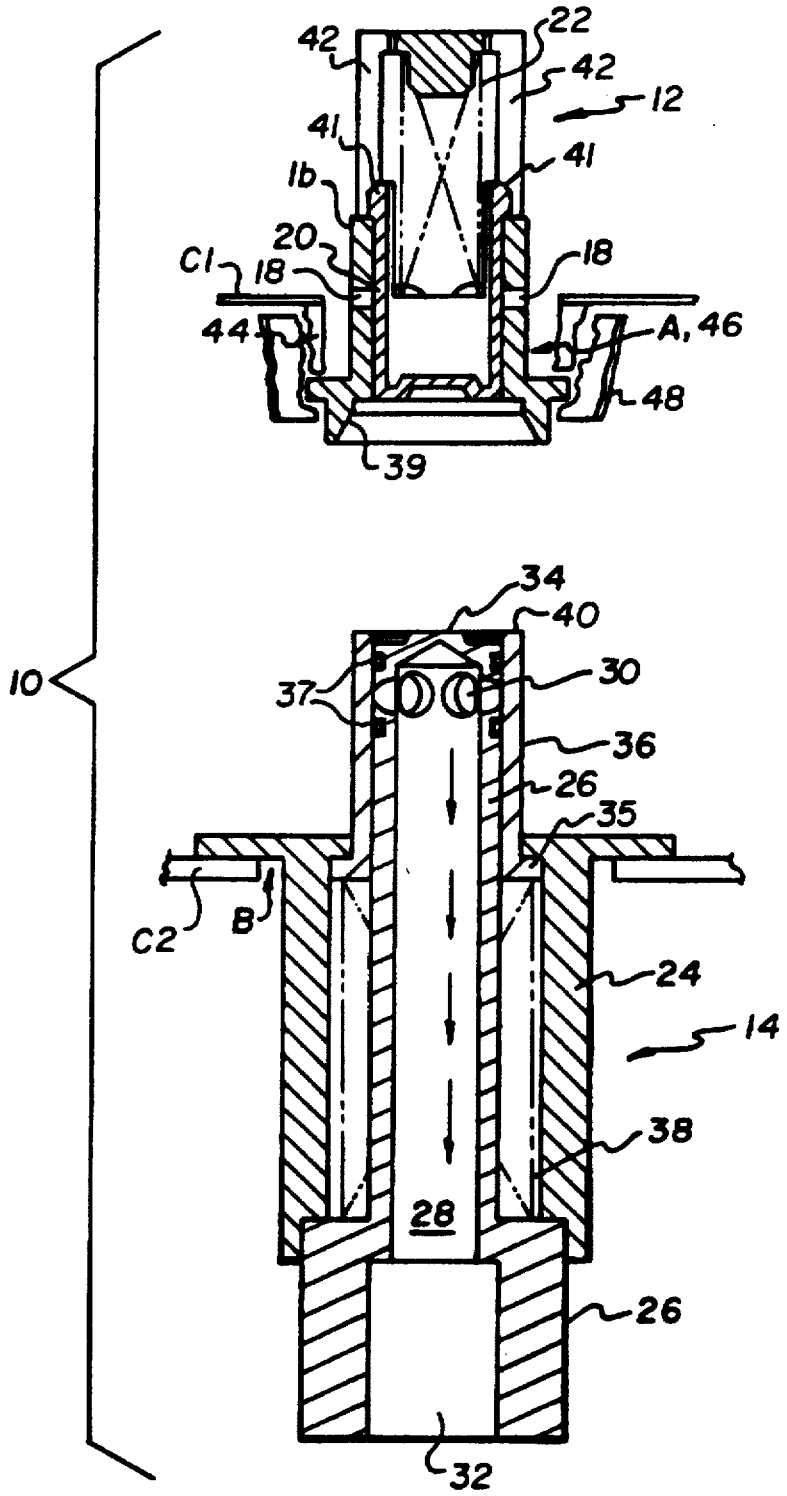
FIG. 5 is an sectional view along line 5—5 of FIG. 1.
Figure 6:
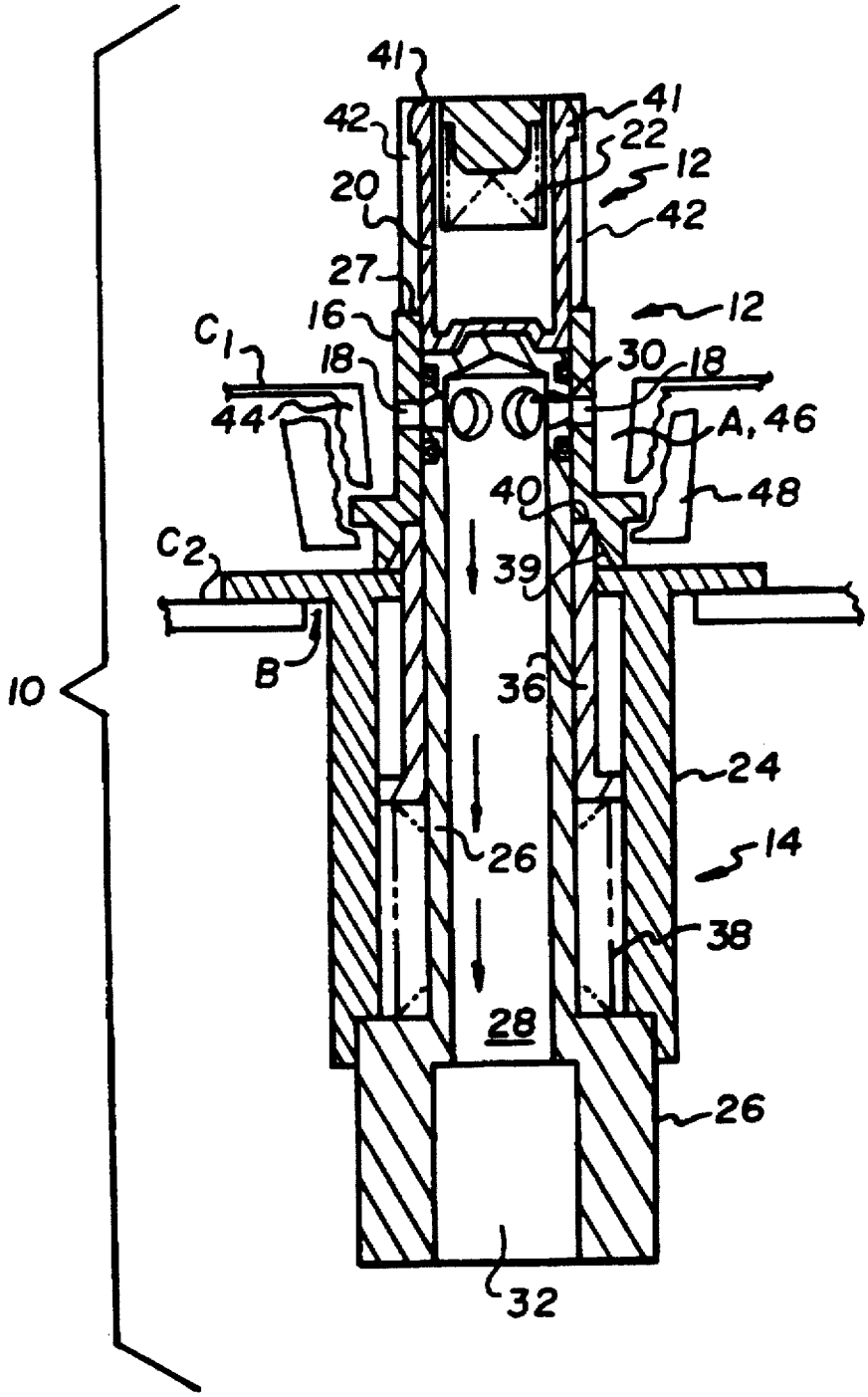
FIG. 6 is a sectional view along the line 6—6 of FIG. 3.

FIGS. 1 to 6 illustrate one embodiment of a valve assemblage 10 of our invention. Valve assemblage 10 may comprise a first valve assembly 12 and a second valve assembly 14. As shown in FIG. 5, assemblies 12, 14 may be engaged to connect adjoining first and second containerized systems $C_1$ and $C_2$. System $C_1$ has a first opening A, in which assembly 12 is mounted. System $C_2$ has a second opening B, in which assembly 14 is mounted. Valve assembly 12 comprises a first body member or sleeve 16; a plurality of radially extended fluid entrance ports 18 to receive fluid from system $C_1$; a hollow piston 20 sealingly slideable within the body member 16 from a first position closing entrance ports 18 as shown in FIG. 5, to a second position opening entrance ports 18 as shown in FIG. 6; and a spring member 22 captured between body 16 and piston 20 for normally biasing piston 20 to close ports 18. For ease of manufacture, ports 18 may be located as pairs on opposite sides of body 16, as indicated in FIGS. 1 and 4.

Valve assembly 14 may comprise a second body member 24, although member 24 is not required to practice the invention. An elongated proboscis member 26 is positioned concentrically within body member 24. Proboscis member 26 comprises a longitudinal channel 28 having a plurality of radial fluid entrance ports 30 to receive fluid from system $C_1$, and an open outlet end 32 to deliver the received fluid to system $C_2$. Entrance ports 30 are positioned at a closed end portion 34 of channel 28. A movable blocking member 36, preferably a sleeve, is slideably mounted telescopically around proboscis member 26 for selectively opening and closing entrance ports 30. A pair of resilient O-rings 37 provide a seal between member 36 and proboscis 26, on either side of entrance ports 30. A spring member 38, captured between blocking member 36 and a shoulder on proboscis 26, normally biases blocking member 36 to the position of FIG. 5 in which inlet ports 30 are closed or blocked. A radial flange 35 on sleeve 36 engages member 24 to limit movement of the sleeve.

When opening A and valve assembly 12 are urged toward opening B and valve assembly 14 of system $C_2$, a flared lip 39 of the first body member 16 engages an exposed lip 40 on blocking member 36. Continued movement causes blocking member 36 to retract to the position of FIG. 6, thus opening entrance ports 30. At the same time, proboscis member 26 engages and displaces piston 20 into the position of FIG. 6, thus opening entrance ports 18. Entrance ports 18 then are opposite opened inlet ports 30, thus forming an open fluid flow path from system $C_1$, though channel 28 to system $C_2$. Thus, liquid may flow from system $C_1$ to system $C_2$, or vice versa. For example, when system $C_1$ comprises a container for chemicals for a photographic processor, liquid may flow from system $C_1$ to system $C_2$, which may be such a processor. Or, if it is desired to refill a container comprised in system $C_1$ with fresh or expended chemicals, liquid may flow from system $C_2$, which may be a supply of fresh or expended chemicals, to system $C_1$.

To disengage valve assemblies 12, 14 and terminate fluid flow between systems $C_1$, $C_2$, opening A is urged away from opening B. Body member 16 of valve assembly 12 thus withdraws from engagement with blocking member 36 which then moves under the influence of spring 38 to close entrance ports 30. As proboscis member 26 disengages from valve assembly 12, piston 20 is freed to move under the influence of spring 22 to close entrance ports 18. In this latter position, a pair of radial stops 41 on piston member 20 engages bottom surfaces of a pair of slots 42 provided through a side wall of body member 16, thus preventing further movement of piston 20. Those skilled in the art will appreciate that other stopping means may be employed. In this way, the flow of fluid is prevented between systems $C_1$,$C_2$.

Figure 16:
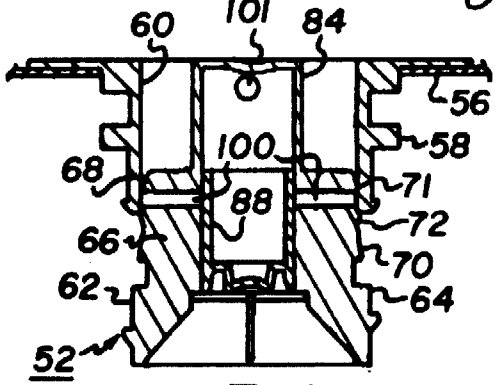
FIG. 16 is a sectional view of an alternative form of one of our valve assemblies.

FIGS. 7 to 11 show an alternative embodiment of our invention. A valve assemblage 50 comprises a first valve assembly 52 which is selectively engageable with a second valve assembly 54. System $C_1$ is shown to comprise a plastic bag or similar flexible container 56 fitted with an essentially cylindrical spout 58 having a central bore 60. A valve cap body 62, which may be made from any suitable injection moldable plastic such as high density polyethylene, includes an exterior circumferential shoulder 64 which engages the end of spout 58 when valve assembly 52 is inserted fully into bore 60. A central boss 66 extends axially on body 62 into bore 60. In the embodiment of FIGS. 7 to 11, a radially and circumferentially extended groove or ledge 68 is provided in the wall of bore 60. Upon full insertion of body 62 into bore 60, groove 68 engages a radially and circumferentially extended catch lip 70 on boss 66 to secure body 62 in bore An additional arrangement is shown in FIG. 16, to be discussed shortly.

Figure 12:
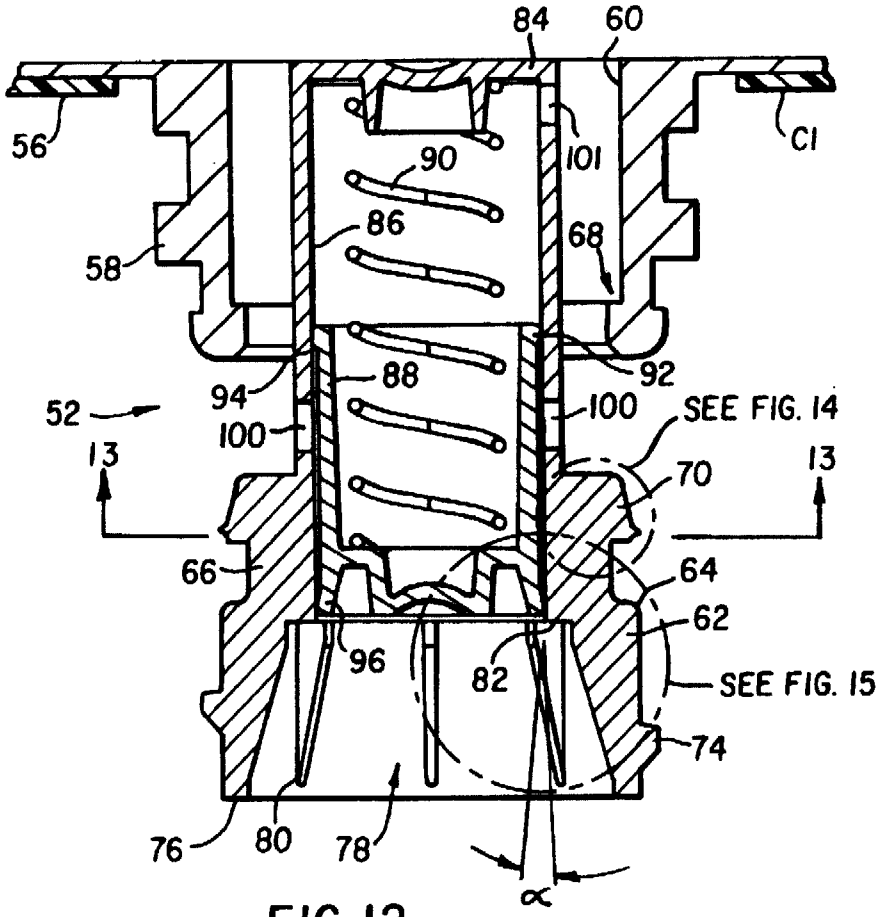
FIG. 12 is a sectional elevation view of one valve assembly of our alternative embodiment when the valve is partially inserted into the spout of the container.
Figure 13:
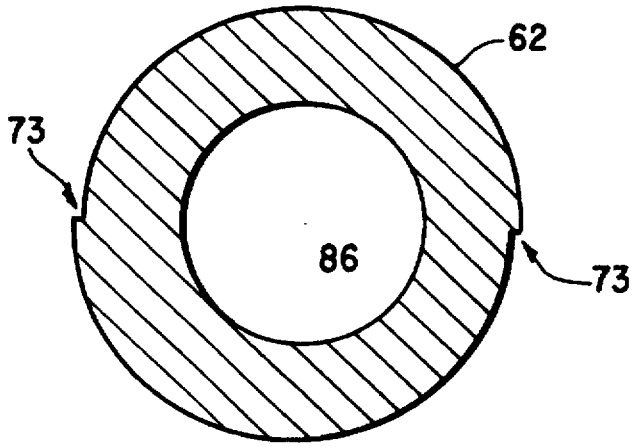
FIG. 13 is a sectional view along line 13—13 of FIG. 12, showing how mold line mismatch can create leakage paths.
Figure 14:
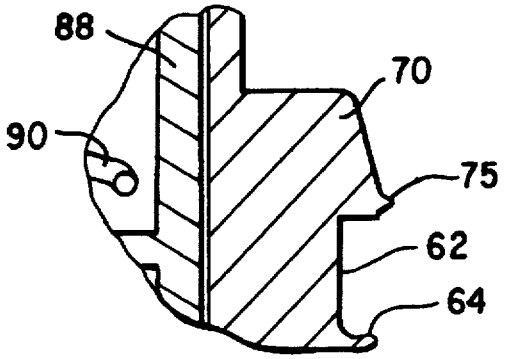
FIG. 14 is an enlarged detail view taken from FIG. 12.

FIGS. 12 to 14 illustrate a feature of the invention which provides an improved seal between lip 70 and bore 68. Valve body 62 may be made by any suitable manufacturing process but is well suited for injection molding. When the valve body is made by a conventional molding machine having two mold halves which separate to release the part, a mold parting line mismatch 73 may be formed in the valve body if the mold halves are not perfectly aligned. Though this mismatch may extend radially for only a few thousandths of an inch, it may be sufficient to permit leakage between the lip and bore in the assembled valve. To account for such a potential mismatch, lip 70 is provided with a radially extending seal flange 75, best seen in FIG. 14. Flange 75 may be essentially triangular in cross section, having a radial extent of about 0.003 to 0.004 inch and an axial extent of about 0.003 to 0.004 inch, which have been found to be sufficient to block any flow path otherwise opened by a mold mismatch. Thus, should a mismatch occur during molding, flange 75 will bridge any leakage path formed at the mismatch but will be readily compressed in areas away from the mismatch.

An exterior thread 74 is provided on body 62 to facilitate engagement with valve assembly 54, as will be explained shortly. Concentric with thread 74, body 62 includes an end land 76 to which a foil seal, not illustrated, may be applied before valve assembly 52 is engaged with spout 58. A threaded cap, also not illustrated, may be installed to protect such a foil seal to provide added assurance of no leakage after bag 56 has been filled. An engagement bore 78 extends into body 62 concentrically with thread 74 and includes a plurality of tapered stiffener gussets 80. At its end opposite land 76, bore 78 is provided with a smaller counter bore to define an annular engagement shoulder 82.

Figure 9:
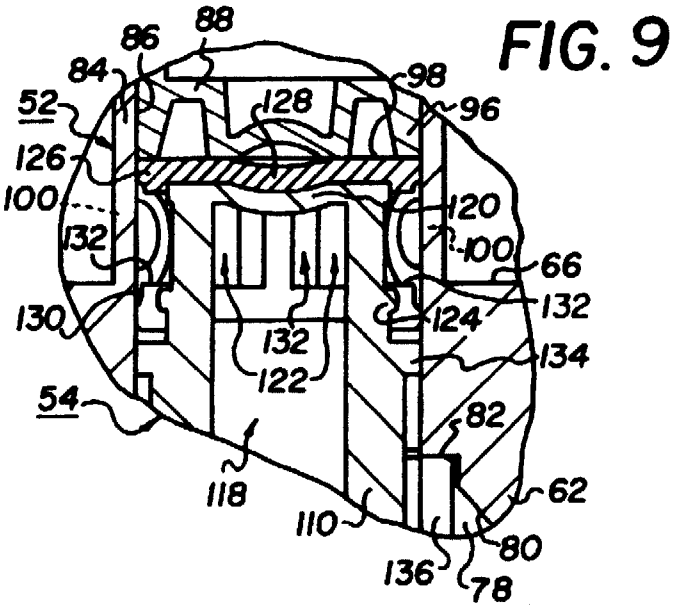
FIG. 9 is a detail view taken from FIG. 11.
Figure 8:
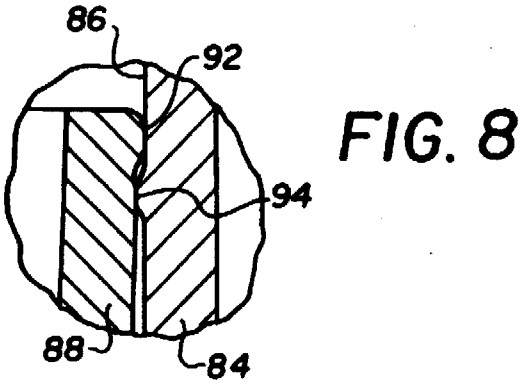
FIG. 8 is a detail view taken at 8—8 in FIGS. 7 and 10.
Figure 15:
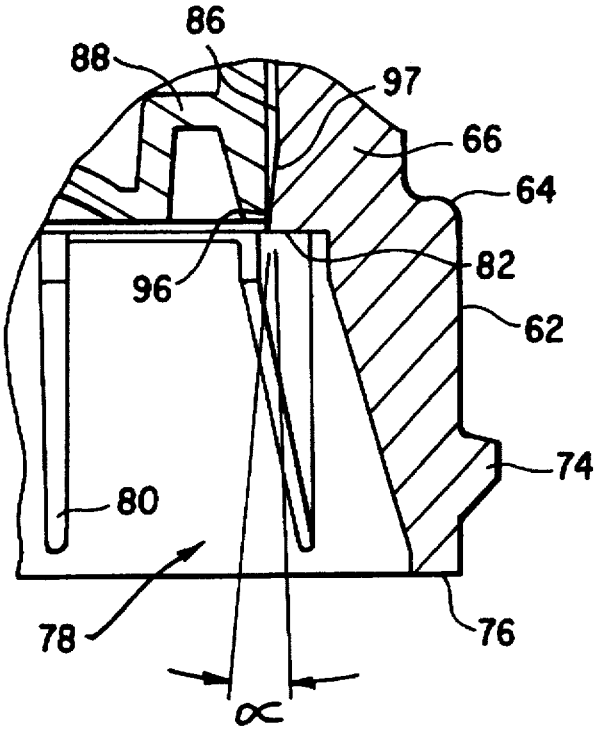
FIG. 15 is an enlarged detail view taken from FIG. 12.
Figure 18:
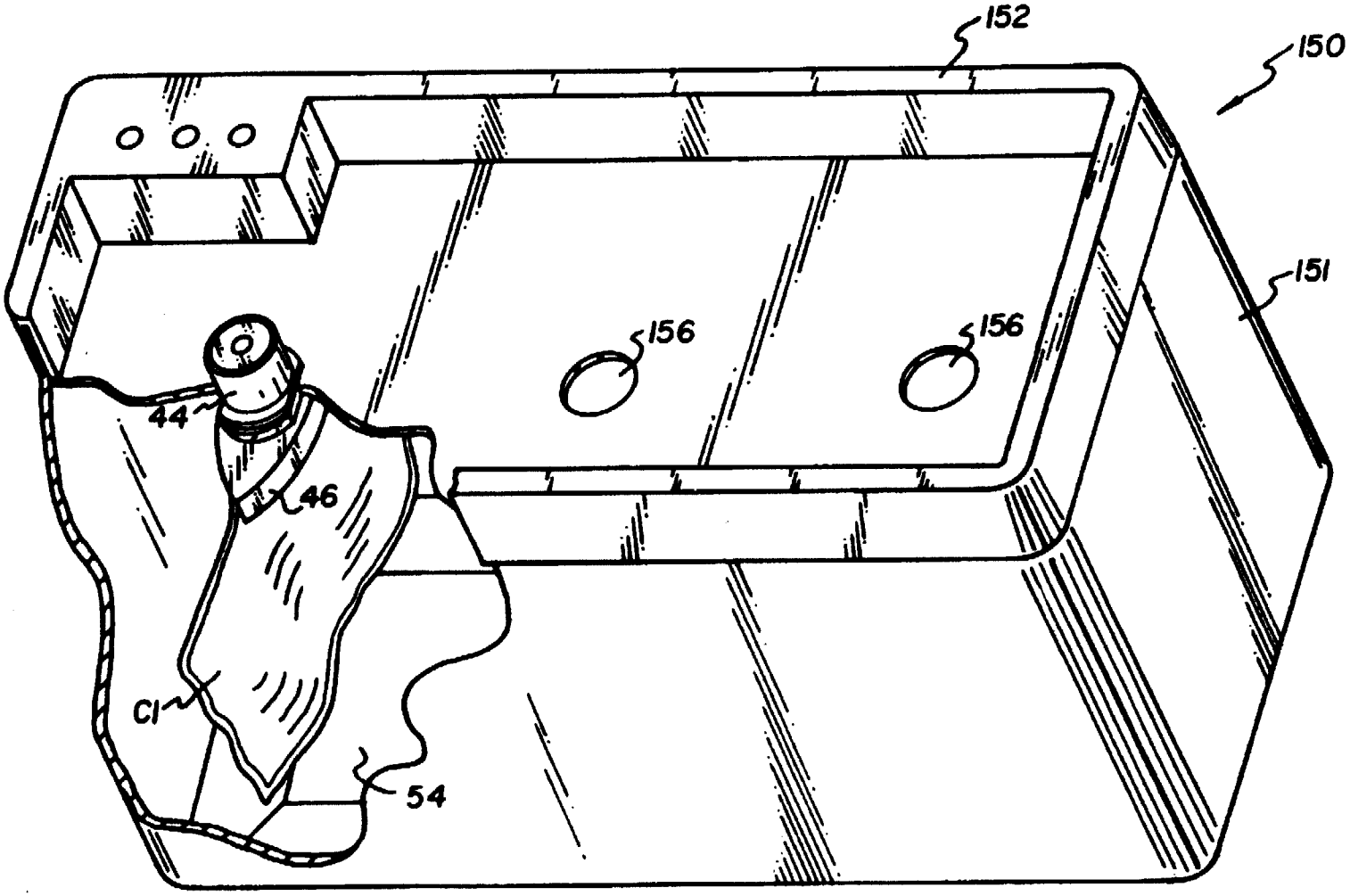
FIG. 18 is a perspective view of a cartridge, partially cut away to show a bag, bag neck and first valve member.
Figure 19:
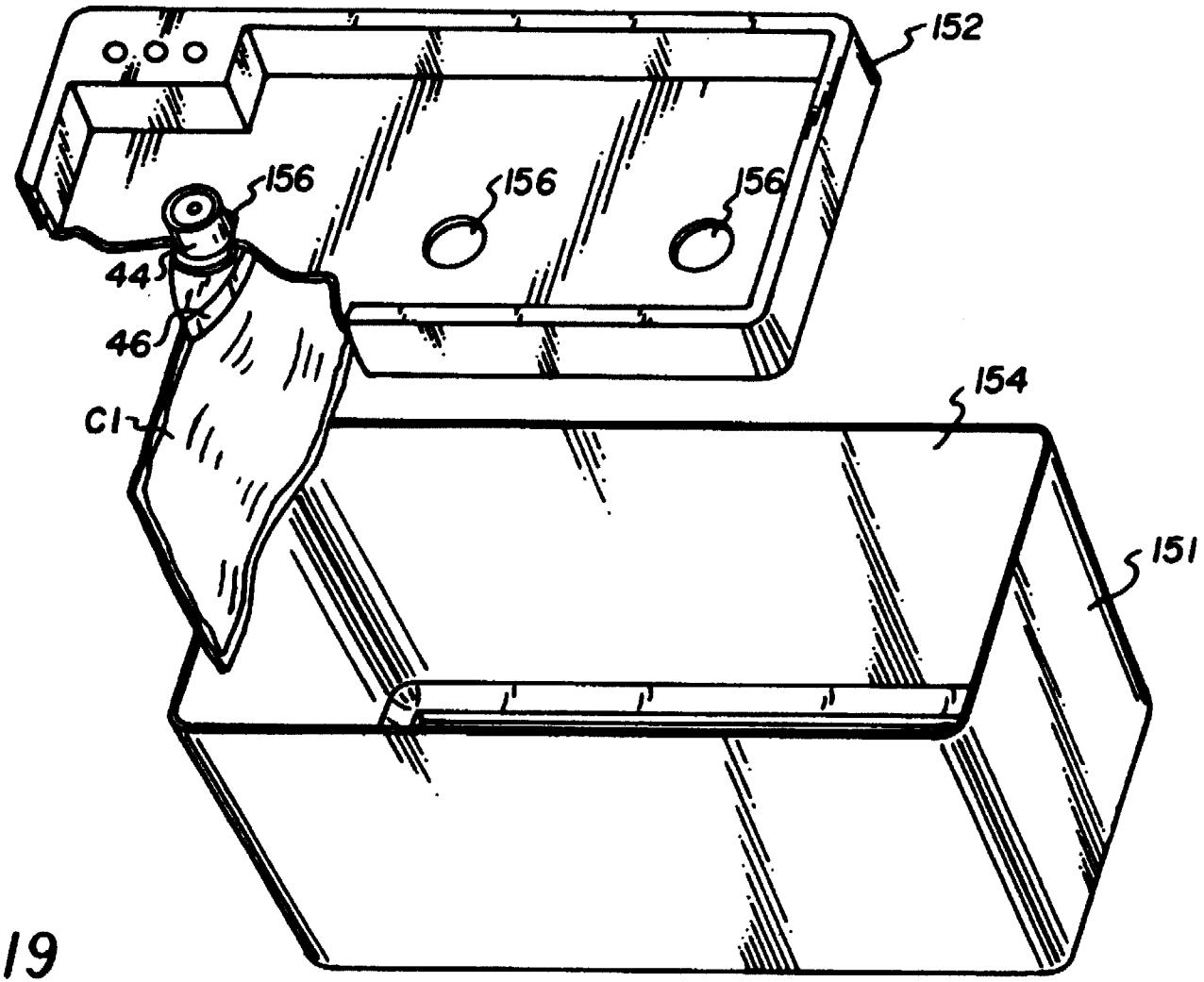
FIG. 19 is a partially exploded view of the cartridge of FIG. 18 showing a cover of the cartridge exploded from the container.

Above shoulder 82, as illustrated, body 62 includes a central, axially extending valve cylinder 84 having an inside bore 86 concentric with shoulder 82. A hollow piston 88 is slideably mounted in bore 86 and biased toward shoulder 82 by a spring 90 captured between cylinder 84 and piston 88. To prevent piston 88 from being ejected from bore 86 by spring 90, as shown in FIG. 8, a radially outwardly extending shoulder 92 is provided on piston 88 and a radially inwardly extending shoulder or catch 94 is provided on bore 86. A slight interference fit is sufficient to prevent spring 90 from forcing the piston out, but not so much as to prevent insertion of the piston during assembly. As best seen in FIG. 9, to provide proper engagement between piston 88 and valve assembly 54, the closed end of the piston is provided with a circumferentially and axially extending lip 96. As best seen in FIGS. 12 and 15, inside bore 86 may be provided with an inward taper 97 at or near its open end, to provide a slight interference fit and seal with lip 96. Taper 97 also permits piston 88 to be made with less exacting tolerances on lip 96. An end surface of a base disk 128 on a sealing head 126, discussed in detail subsequently, has a circumferential surface 98 which can seat against lip 96, thus preventing fluid from entering the space between piston 88 and sealing head 126. Finally, piston 88 is movable within bore 86 from the position of FIG. 7 in which a plurality of fluid entrance ports 100 are closed or blocked by the piston, to the position of FIG. 11 in which the piston has been raised above ports 100.

FIG. 16 illustrates an alternative form of cap body 62. Central boss 66 is elongated to extend above and include fluid entrance ports 100. Above catch lip 70, and on opposite sides of ports 100, are radially and circumferentially extended catch lips 71 and 72, which are spaced axially to allow lip 71 to engage groove 68 when lip 72 engages the end of spout 58, as illustrated. Lips 71, 72 permit valve assembly 52 to be initially installed as shown in FIG. 16 before system $C_1$ has been filled. When filling is to be done, assembly 52 can be removed readily from the position of FIG. 12. After filling has been completed, assembly 52 may be inserted fully into bore 60 until lip 70 engages groove 68 to prevent subsequent easy removal of assembly 52. To permit fluid flow from system $C_1$ through entrance ports 100, however, lip 71 and preferably boss 66 should be provided with notches or recesses, not illustrated, to allow flow past lip 71 to ports 100. A relief port 101 preferably is provided at the upper end of valve cylinder 84.

Valve assembly 54 comprises a screw cap 102 which may be made from any suitable injection moldable plastic such as high density polyethylene. Cap 102 includes an internal screw thread 104 to mate with thread 74 during engagement of the valve assemblies. An axially extending bonnet 106 is provided with a central bore 108 within which an elongated proboscis member 110 is positioned. Threads 112 on the proboscis member engage a pair of nuts 114, 116 on either side of bonnet 106 to secure the assembly. A central bore 118 in proboscis member 110 extends to a closed end 120 provided with a plurality of radial fluid entrance ports 122, as best seen in FIG. 9.

On its outside surface near closed end 120, the proboscis member includes a radial seal retention flange 124. Resiliently snapped over flange 124 is a sealing cup or head 126 which may be made from any convenient resilient seal material, such as silicone rubber. Head 126 comprises a circular, imperforate base disk 128 which engages the end surface of the proboscis member. Molded integrally with base disk 128 is a cylindrical wall 130, which snaps over flange 124. A plurality of radial fluid entrance ports 132 are provided through wall 130, in position opposite ports 100, as best seen in FIG. 9.

Spaced further along the proboscis member is an exterior, radially outwardly extending retention flange 134. Slideably mounted on the proboscis member is a blocking member or sleeve 136 having a radially inwardly extending stop flange 138 for engaging flange 134 under the influence of a spring 140 captured between flange 138 and nut 114. A hose fitting 142 is provided at the open end of proboscis member 110, for ready attachment of a fluid delivery hose 144 connected to system $C_2$.

Figure 7:
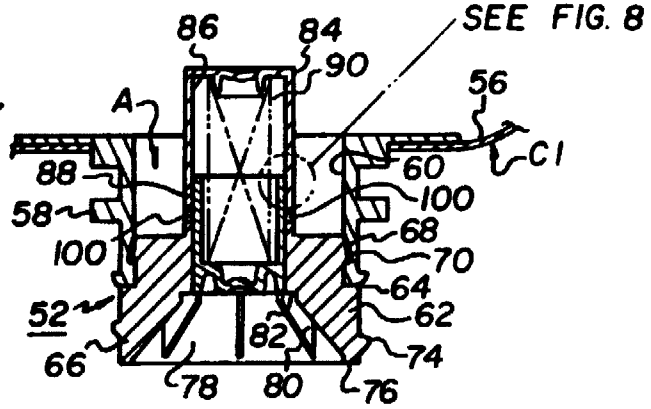
FIG. 7 is an sectional view of an alternative embodiment of our valve assemblage when disengaged.
Figure 7:
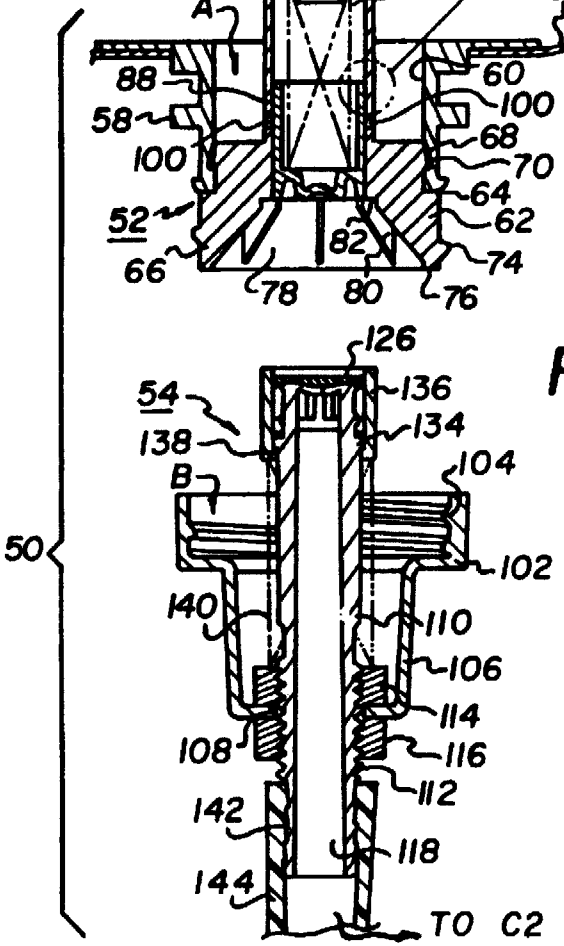
Figure 11:
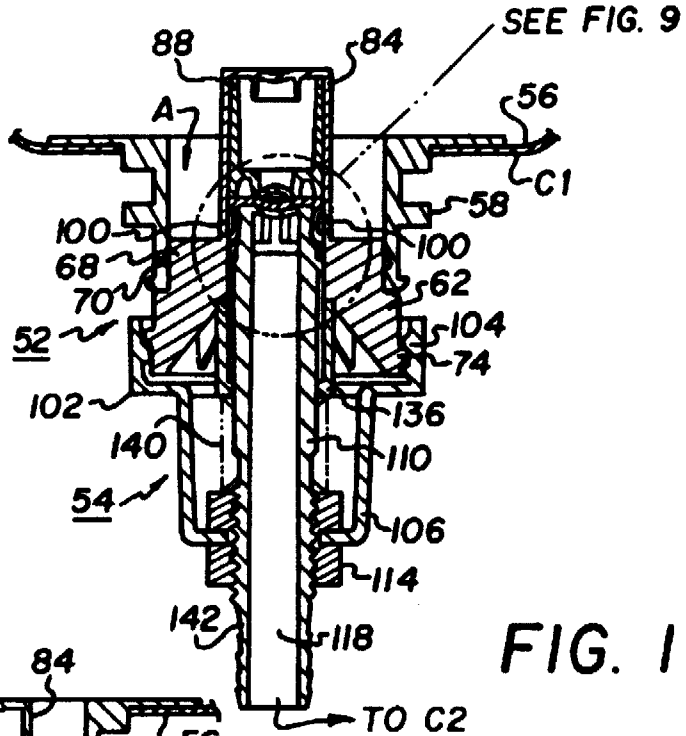
FIG. 11 is a sectional elevation view of our alternative embodiment when fully engaged.
Figure 17:
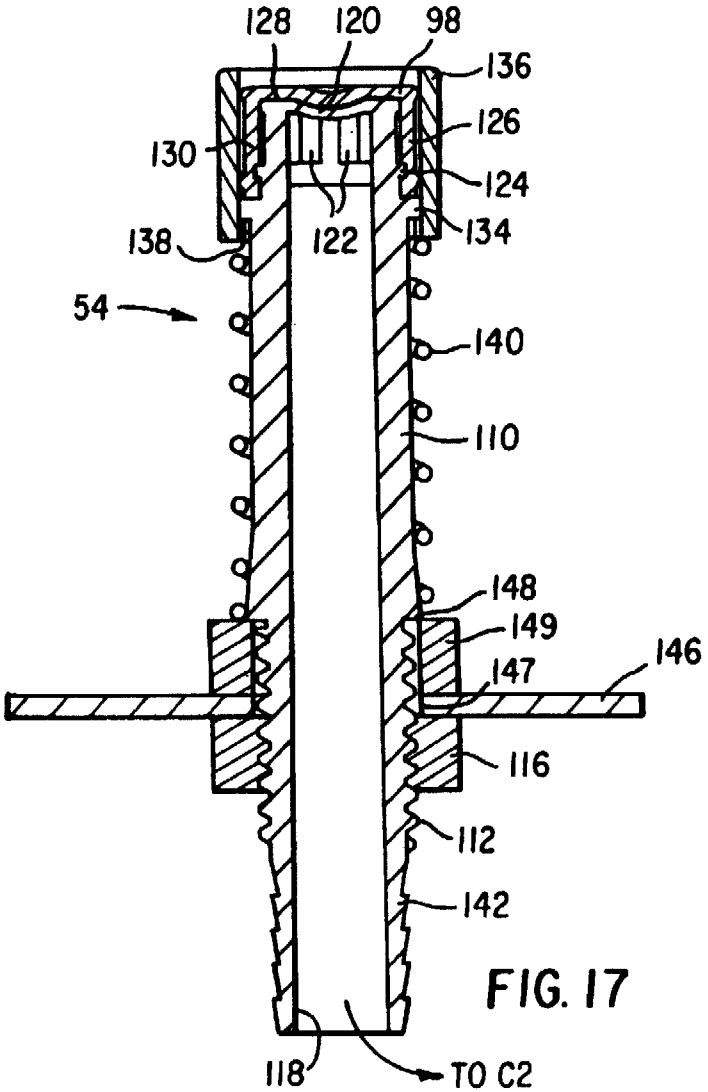
FIG. 17 is a sectional view of the other valve assembly of our alternative embodiment, showing an improved mounting system for the proboscis member.

Alternatively, proboscis member 110 may be mounted directly to the associated apparatus, simply by removing screw cap 102 and mounting the proboscis member in the frame of the apparatus. Whether the proboscis member is mounted to screw cap 102 or the associated apparatus, the angular orientation of the proboscis member relative to its support must be such that proper engagement with piston 88 can be achieved. In the arrangement of FIG. 7, use of nuts 114, 116 can result in a considerable lack of perpendicularity between the cap or associated apparatus and the proboscis member, due to typical tolerances between the threaded pans. In the improved version shown in FIG. 17, a frame plate 146 in the associated apparatus (or cap 102 may be used similarly) is provided with a through hole 147 through which the proboscis member extends. A radial stop 148 on the proboscis member engages a flat washer 149 which bears on the frame plate, nut 116 being tightened against the opposite side of the frame plate. This arrangement ensures that the proboscis member will be essentially perpendicular to its support and that sealing engagement with piston 88 and bore 86 will be achieved.

Figure 10:
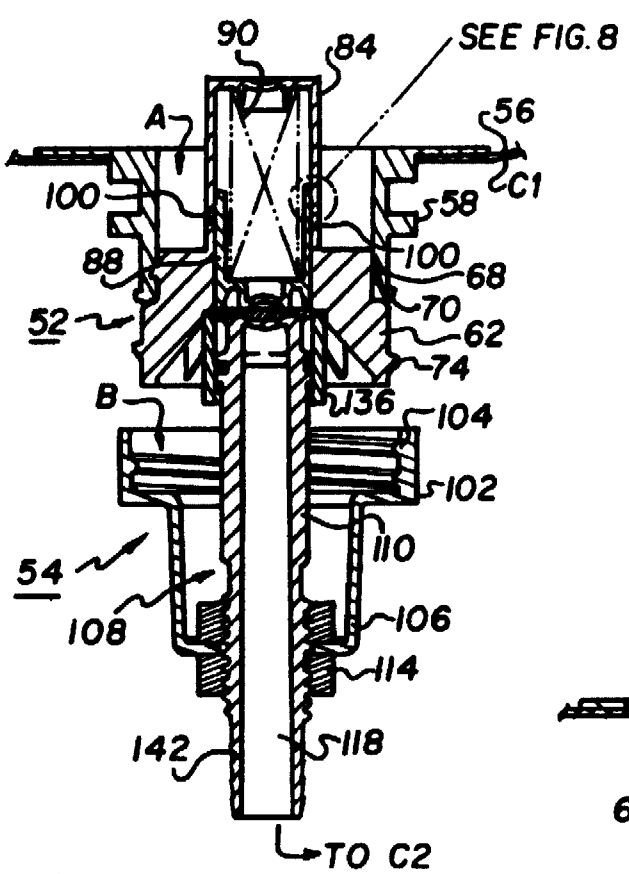
FIG. 10 is a sectional elevation view of our alternative embodiment when initially engaged.

In operation of the alternative embodiment, valve assembly 52 is brought into engagement with valve assembly 54, as illustrated in FIG. 10. Continued movement causes sleeve 136 to begin to retract down the proboscis member and, at the same time, piston 88 to move upward into bore 86. Threads 74, 104 eventually can be engaged and relatively rotated, to bring the valve assemblies to the fully engaged condition of FIG. 11. Fluid flow is then permitted from system $C_1$ sequentially through ports 100, ports 132, ports 122, along bore 118, and through hose to system $C_2$. As in the case of the embodiment of FIGS. 1 to 6, flow through the assemblage may be in either direction, depending on which system is being drained and which is being filled. To disengage systems $C_1$; $C_2$, threads 74, 104 are relatively rotated to return to the condition of FIG. 10. During engagement, ports 132 are uncovered by blocking member 136 and covered again by inside bore 86, just before ports 100 are uncovered by piston 88, thus preventing leakage. During disengagement, the sequence is reversed, also preventing leakage.

As shown schematically in FIGS. 5 and 18 to 20, system $C_1$ may be a flexible bag having a neck portion 44 surrounding an opening 46 in the bag. A cap member 48 may be removably mounted on the neck portion 44 for retaining valve assembly 12, the cap member having a central opening for access to valve assembly 12. Either arrangement may be incorporated in a cartridge, such as a rigid container 150. Container 150 comprises an openable body portion 151, a cover 152 for closing openable body portion 151, and an interior compartment 154 for containing multiple plastic bags in the body portion 151. Openings 156 are provided in the cover 152 to accommodate the neck portion 44 of the plastic bag.

Figure 20:
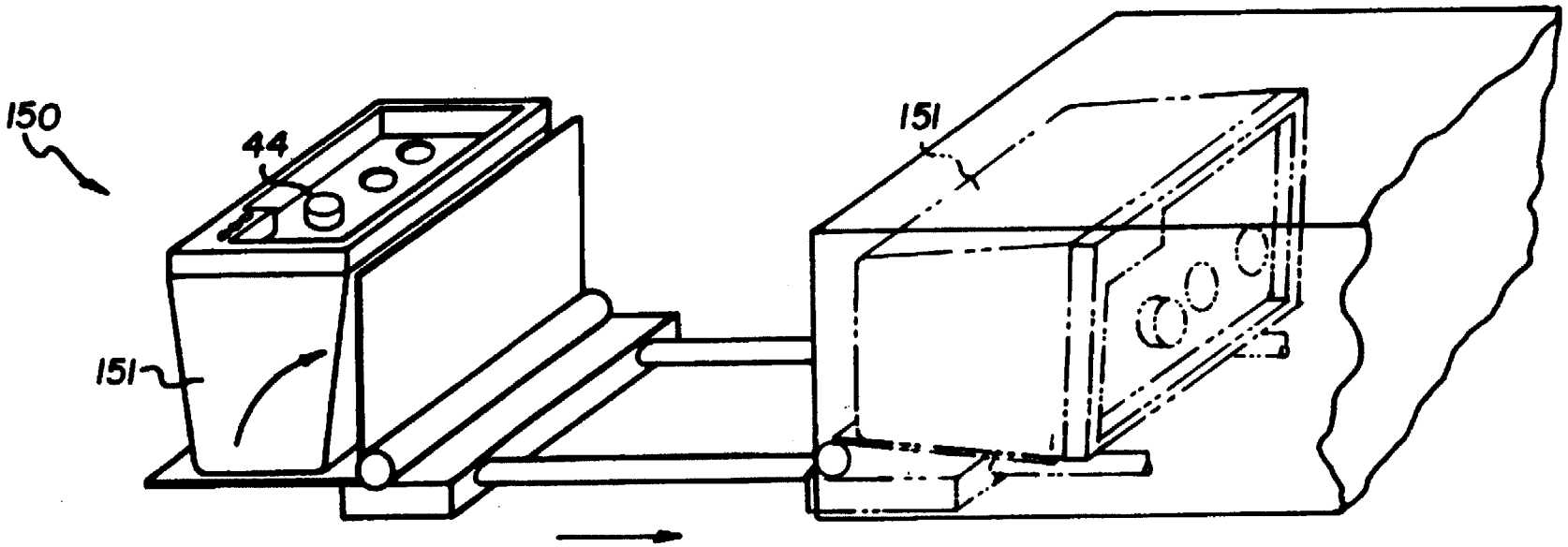
FIG. 20 is a perspective view of a cartridge handling system.

FIG. 20 shows one way of using the valve assemblage 10 or 50 of the invention in a rigid container 150. Rigid container 150 is shown first in an upright position ready for positioning by, for example, tilting towards and into (denoted by arrows) a machine having a second containerized system. Replenishment of fluids between system $C_1$ formed by rigid container 150 and system $C_2$ of the machine is completed in the manner already described.

Our invention has been described with reference to certain embodiments thereof, but it will be understood that variations and modifications can be effected within the scope of our invention.

Parts List

10 . . . valve assemblage
12 . . . first valve assembly
14 . . . second valve assembly
$C_1$. . . first containerized system
$C_2$. . . second containerized system
A . . . first opening in C1
B . . . second opening in C2
16 . . . first body member
18 . . . fluid entrance port in 16
20 . . . hollow piston within 16
22 . . . spring
24 . . . second body member
26 . . . proboscis member
28 . . . longitudinal channel in 26
30 . . . radial fluid entrance port 26
32 . . . open outlet end of 28
34 . . . first, closed end of 28
35 . . . radial flange on 36
36 . . . blocking member
37 . . . O-ring seal
38 . . . spring
40 . . . exposed lip of 36
41 . . . radial stops on 20
42 . . . axial slots in 16
44 . . . neck portion
46 . . . opening
48 . . . cap
50 . . . alternative valve assemblage
52 . . . first valve assembly
54 . . . second valve assembly
56 . . . plastic bag
58 . . . spout from 56
60 . . . central bore in 58
62 . . . cap valve body
64 . . . shoulder on 62
66 . . . central, axially extending boss on 62
68 . . . radially, circumferentially extended groove in 60
70 . . . radially, circumferentially extended lip on 66
71 . . . radially, circumferentially extended lip on 66
72 . . . radially, circumferentially extended lip on 66

73 . . . mold parting line mismatch on 62
74 . . . exterior thread on 62
75 . . . radial seal flange on 70
76 . . . end land on 62
78 . . . engagement bore in 62
80 . . . stiffening gussets in 78
82 . . . annular engagement shoulder
84 . . . valve cylinder extension of 62
86 . . . inside bore in 84
88 . . . hollow piston
90 . . . spring
92 . . . circumferential shoulder on 88
94 . . . circumferential catch on shoulder on 86
96 . . . circumferential lip on end of 88
97 . . . inward taper at open end of 86
98 . . . circumferential seating surface on 126
100 . . . fluid entrance port through 88
101 . . . relief port in 84
102 . . . screw cap
104 . . . internal screw thread
106 . . . bonnet of 102
108 . . . bore through 106
110 . . . proboscis member
112 . . . threads on 110
114, 116 . . . retaining nuts
118 . . . central bore through 110
120 . . . closed end of 118
122 . . . radial fluid entrance port in 110
124 . . . exterior radial retention flange on 110
126 . . . sealing head
128 . . . circular imperforate base disk of 126
130 . . . depending cylindrical wall of 126
132 . . . radial fluid entrance port in 126
134 . . . exterior radial retention flange on 110
136 . . . blocking member or sleeve
138 . . . interior radial flange on 136
140 . . . spring between 114 and 136
142 . . . hose fitting
144 . . . hose
146 . . . plate
147 . . . hole through 146
148 . . . radial stop on 110
149 . . . flat washer
150 . . . rigid container
151 . . . body portion
152 . . . cover
154 . . . interior compartment
156 . . . opening in 152

We claim:

1. A valve assemblage for controlling flow of fluid between a first system containing fluid to be dispensed and a second system for receiving the fluid, the first system having a first opening, and the second system having a second opening, the assemblage comprising:

a first valve assembly adapted to be positioned at the first opening, the first valve assembly comprising a body member, a fluid entrance port in the body member to receive fluid from the first system, a piston slideable within the body member from a first position closing the entrance port, to a second position opening the closed entrance port, and a first spring member normally biasing the piston to the first position;

a second valve assembly adapted to be positioned at the second opening, the second valve assembly comprising a proboscis member, the proboscis member comprising a channel having an inlet end to receive fluid from the fluid entrance port in the body member and an outlet end to deliver the received fluid to the second system, the inlet end being positioned at a first end portion of the proboscis member, a blocking member movable relative to the proboscis member from a first position closing the inlet end to a second position opening the inlet end, and a second spring member normally biasing the blocking member to the position closing the inlet end;

wherein, when the first opening is urged toward the second opening, the first body member of the first valve assembly engages and moves the blocking member thereby opening the inlet end of the proboscis member, and the proboscis member displaces the piston into the position opening the entrance port, the opened entrance port then being in fluid communication with the opened inlet end, thereby forming an open fluid flow channel between the first system and the second system;

wherein, when the first opening is urged away from said second opening, the body member is withdrawn from the proboscis member, the blocking member moves to close the inlet end, and the proboscis member disengages from the piston to allow the piston to slide to the position closing the entrance port, thereby preventing flow of fluid between the first and second systems; and wherein when the first opening is urged toward the second opening, the blocking member opens the inlet end before the piston is displaced sufficiently to position the entrance port in communication with the through channel; and when the first opening is urged away from the second opening, the piston closes the entrance port before the blocking member closes the inlet end, whereby leakage from the first system containing fluid to be dispensed is prevented when the first opening is urged toward or away from the second opening.

2. The valve assemblage in claim 1 wherein the blocking member is a sleeve member surrounding the inlet end of the proboscis member and movable from the position closing the inlet end to the position opening the inlet end.

3. The valve assemblage recited in claim 2 wherein the first valve assembly is mounted to a flexible bag for a fluid to be transferred.

4. The valve assemblage recited in claim 3 wherein the flexible bag is enclosed in a substantially rigid housing assemblage.

5. The valve assemblage recited in claim 3 wherein the flexible bag comprises a spout having a central bore into which the body member is installed, the bore comprising a circumferential groove and the body member comprising a pair of axially spaced, circumferentially extended lips for engaging the groove, whereby the body member may be partially inserted in the bore until one of the lips engages the groove or fully inserted in the bore until the other of the lips engages the groove.

6. The valve assemblage recited in claim 5, wherein the fluid entrance port is between the lips.

7. The valve assemblage recited in claim 1, further comprising at least one seal between the proboscis member and the blocking member.

8. The valve assemblage recited in claim 7, wherein the blocking member is a sleeve member surrounding the inlet end of the proboscis member and the seal comprises a base disk engaging the first end portion and a perforated cylindrical wall extended from the base disk past the inlet end, the cylindrical wall being extended between the proboscis member and the sleeve member.

9. The valve assemblage recited in claim 1, further comprising a frame plate in the second system for mounting the proboscis member;

a through hole defined by the frame plate, the through hole having a first end and a second end, the proboscis member being mounted in the through hole;

a radially extended stop on the proboscis member;

a flat washer engaged between the stop and the frame at the first end of the through hole;

a threaded portion on the proboscis member extended through the second end of the through hole; and a threaded nut engaged with the threaded portion and the frame at the second end of the through hole, whereby the proboscis member is positioned for engagement with the first valve assembly.

10. The valve assemblage in claim 1, wherein the body member of the first valve assembly comprises a bore in which the piston is located, the bore being tapered inwardly to seal the piston against the bore of the body member.

11. The valve assemblage in claim 1, wherein the first valve assemblage is mounted to a flexible container for a fluid to be transferred, the flexible bag comprising a spout with a central bore into which the body member is installed, the bore comprising a circumferential groove and the body member comprising a circumferentially extended lip for engaging the groove, the lip including a circumferentially extended seal flange for engaging the groove and providing a seal between the central bore and the body member.

12. The valve assemblage in claim 1, wherein the first system contains photographic processing chemicals.

13. A valve assemblage according to claim 1, wherein the blocking member is a sleeve surrounding the inlet end, further comprising a seal between the proboscis member and the sleeve, the seal comprising a base disk engaging the first end portion and a perforated cylindrical wall extended from the base disk past the inlet end, the cylindrical wall being extended between the proboscis member and an inside surface of the sleeve.

14. A valve assemblage according to claim 13, wherein engaging surfaces between the base disk and the piston comprise means for preventing entrapment of fluid there between.

15. A method of controlling the flow of fluid between a first system for containing a fluid to be dispensed and a second system for receiving the fluid, the first system having a first opening and the second system having a second opening, the method comprising the steps of:

providing a first flow control assembly positioned at the first opening, the first flow control assembly comprising a body member, a fluid entrance port in the body member, a piston slideable within the body member to open and close the entrance port, and a first spring member normally biasing the piston to a position closing the entrance port;

providing a second flow control assembly positioned at the second opening, the second flow control member comprising a proboscis member having a through channel with an inlet end and an outlet end, a blocking member movable relative to the proboscis member to open and close the inlet end, and a second spring member for biasing the blocking member to a position closing the inlet end;

urging the first opening toward the second opening so that the body member engages and moves the blocking member to open the inlet end, and the proboscis member displaces the piston thereby positioning the fluid entrance port in fluid communication with the through channel for enabling fluid flow between the first and second;

withdrawing the first system away from the second system so that body member of the first flow control assembly withdraws to permit the blocking member to close the through channel, and the proboscis member retracts to permit the piston to close the entrance port, thereby preventing fluid flow between the first and second containerized systems, wherein, during the urging step, the blocking member opens the inlet end before the piston is displaced sufficiently to position the entrance port in communication with the through channel; and during the withdrawing step, the piston closes the entrance port before the blocking member closes the inlet end, whereby leakage from the first system containing fluid to be dispensed is prevented during the urging and withdrawing steps.

16. A method as recited in claim 15, wherein the fluid is a photographic processing chemical which flows from the first system to the second.

* * * * *